US009506189B2

(12) United States Patent
Hill et al.

(10) Patent No.: US 9,506,189 B2
(45) Date of Patent: Nov. 29, 2016

(54) METHOD FOR MAKING A PAPERMAKING BELT

(71) Applicant: The Procter & Gamble Company, Cincinnati, OH (US)

(72) Inventors: Michael Douglas Hill, Eaton Township, PA (US); Nathan Michael Hill, Eaton Township, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 218 days.

(21) Appl. No.: 14/492,343

(22) Filed: Sep. 22, 2014

(65) Prior Publication Data

US 2016/0083906 A1 Mar. 24, 2016

(51) Int. Cl.
*D21F 1/00* (2006.01)
*D21G 9/00* (2006.01)
(Continued)

(52) U.S. Cl.
CPC ..... *D21F 1/0027* (2013.01); *D21F 1/0036* (2013.01); *D21F 7/06* (2013.01);
(Continued)

(58) Field of Classification Search
CPC .. D21F 1/0027; D21F 1/0036; D21F 1/0045; D21F 1/0054; D21F 1/0063; D21F 1/0072; D21F 1/0081; D21F 1/10; D21F 1/105; D21F 1/12; D21F 7/08; D21F 7/083; D21F 7/086; D21F 7/10; D21F 7/12; D21F 2/00; D21F 3/0227; D21F 3/0236; D21F 7/06; D21F 11/00; D21F 11/006; D21F 11/14; D21G 9/0009; D21G 9/0027; D21G 9/0036; D21H 27/002; D21H 27/02
USPC ..... 162/109, 116, 348, 358.1, 358.2, 358.4, 162/900–904, 198, 262, 263
See application file for complete search history.

(56) References Cited

U.S. PATENT DOCUMENTS 5,334,289 A * 8/1994 Trokhan ..... B29C 35/10 162/358.2
5,403,447 A 4/1995 Järvinen et al.
(Continued)

FOREIGN PATENT DOCUMENTS

DE 102011006137 * 9/2012
WO WO93/21378 A1 10/1993
(Continued)

OTHER PUBLICATIONS

DE 102011006137, Sep. 2012, English language machine translation [www.epo.org].*
(Continued)

*Primary Examiner* — Eric Hug
(74) *Attorney, Agent, or Firm* — Peter D. Meyer

(57) ABSTRACT

A method of making a papermaking belt is disclosed. The papermaking belt has a reinforcing structure and a framework. The method comprises the steps of: (a) providing a reinforcing structure having a paper-facing side, a machine-facing side opposite the paper-facing side, interstices and a reinforcing component comprised of a plurality of structural components; (b) providing a first portion of the reinforcing component with a measuring device, the measuring device being disposed upon the first portion of the reinforcing component; and, (c) coating the at least one side of the reinforcing structure with a material so that the material forms a first surface and a second surface, the material being distributed so that the paper-facing side of the reinforcing structure and the measuring device is positioned between the first and second surfaces of the material.

20 Claims, 5 Drawing Sheets

(51) Int. Cl.

| | |
|---|---|
| ***D21F 7/06*** | (2006.01) |
| ***D21F 7/08*** | (2006.01) |
| ***D21F 7/12*** | (2006.01) |
| ***D21F 11/14*** | (2006.01) |
| ***D21F 11/00*** | (2006.01) |
| *D21H 27/00* | (2006.01) |
| *D21H 27/02* | (2006.01) |

(52) U.S. Cl.
CPC ..... *D21F 7/08* (2013.01); *D21F 7/12* (2013.01); *D21F 11/006* (2013.01); *D21F 11/14* (2013.01); *D21G 9/0009* (2013.01); *D21G 9/0027* (2013.01); *D21G 9/0036* (2013.01); *D21H 27/002* (2013.01); *D21H 27/02* (2013.01)

(56) References Cited

U.S. PATENT DOCUMENTS

| | | | | |
|---|---|---|---|---|
| 5,413,680 | A | 5/1995 | Nunn | |
| 5,434,878 | A | 7/1995 | Lawandy | |
| 5,448,582 | A | 9/1995 | Lawandy | |
| 5,614,063 | A | 3/1997 | Graf et al. | |
| 6,158,576 | A | 12/2000 | Eagles et al. | |
| 6,461,701 | B1 * | 10/2002 | Schlueter, Jr. | G03G 15/754 264/512 |
| 7,276,137 | B2 * | 10/2007 | Best | D21F 1/0027 162/198 |
| 7,873,433 | B2 * | 1/2011 | Bock | D21F 1/0027 162/109 |
| 8,475,347 | B2 | 7/2013 | Gustafson et al. | |
| 2002/0179270 | A1 | 12/2002 | Gustafson et al. | |

FOREIGN PATENT DOCUMENTS

| | | | |
|---|---|---|---|
| WO | WO-97/27360 | | 7/1997 |
| WO | WO 2012/085338 | * | 6/2012 |
| WO | WO-2012/085338 A1 | | 6/2012 |
| WO | WO2012117160 A1 | | 9/2012 |

OTHER PUBLICATIONS

PCT International Search Report, mailed Nov. 25, 2015, 212 pages.
U.S. Appl. No. 14/492,326, filed Sep. 22, 2014, Michael Douglas Hill, et al.
U.S. Appl. No. 14/492,458, filed Sep. 22, 2014, Michael Douglas Hill, et al.

* cited by examiner

METHOD FOR MAKING A PAPERMAKING BELT

FIELD OF THE INVENTION

The present disclosure generally relates to methods for making papermaking belts useful in papermaking machines for making strong, soft, absorbent paper products. More particularly, the present disclosure relates to methods for making papermaking belts formed from a resinous framework and a reinforcing structure having sensors embedded therein that provide process feedback that can significantly increase in the operating lifetime of the papermaking belt.

BACKGROUND OF THE INVENTION

Processes for the manufacturing of paper products for use in tissue, toweling and sanitary products generally involve the preparation of an aqueous slurry of paper fibers and then subsequently removing the water from the slurry while contemporaneously rearranging the fibers in the slurry to form a paper web. Various types of machinery can be employed to assist in the dewatering process.

The processes to manufacture these paper products use a paper slurry that is fed onto the top surface of a traveling endless belt that serves as the initial papermaking surface of the machine. These papermaking belts or fabrics carry various names depending on their intended use. Fourdrinier wires, also known as Fourdrinier belts, forming wires, or forming fabrics are used in the initial forming zone of the papermaking machine. Dryer fabrics carry the paper web through the drying operation of the papermaking machine.

One particular papermaking belt utilizes a foraminous woven member surrounded by a hardened photosensitive resin framework. The resin framework has a plurality of discrete, isolated, channels known as "deflection conduits" disposed therein. The process to manufacture a paper product can involve the steps of associating an embryonic web of papermaking fibers with the top surface of the papermaking belt, deflecting the paper fibers into the deflection conduits, and applying a vacuum or other fluid pressure differential to the web from the backside (machine-contacting side) of the papermaking belt. This process made it finally possible to create paper having certain desired preselected characteristics.

Although the aforementioned process produces suitable papermaking belts and results in superior formed paper products, it has been found that the papermaking manufacturing environment severely limits the lifetime of these papermaking belts. This could be attributed to the inability to measure certain key physical parameters of the papermaking belt during use. By way of example, the equipment used in the manufacture of paper products subjects the papermaking belt to extreme temperatures, bending moments, tensions, stress, strain, pH, wear, and the like. Each of these factors has been found to severely limit the life of the papermaking belts by causing micro-fractures to occur in the hardened resins that form the surface of the papermaking belt as well as fractures due to oxidation and decay of the resin itself. Without desiring to be bound by theory, resin loss is believed to be the primary cause of belt failure. This is particularly true of papermaking systems that incorporate the use of high temperature pre-dryers and Yankee drying drums. Additionally, the high pressures experienced by the papermaking belt in process nips (formed between pressure rolls) and vacuum slots, as well as process abrasion points (e.g., while traversing vacuum boxes and the like) and stresses introduced by misaligned process equipment have been linked to premature papermaking belt failures.

The significance of the difficulties experienced by users of these papermaking belts is exacerbatingly increased by the relatively high cost of the papermaking belts themselves. For example, manufacturing a foraminous woven element that is incorporated into these belts requires expensive textile processing operations, including the use of large and costly looms. Also, substantial quantities of relatively expensive filaments are incorporated into these foraminous woven elements. The cost of these papermaking belts is further increased when filaments having high heat resistance properties are used. These special filaments are generally necessary for papermaking belts that pass through various high temperature drying operations.

In addition to the cost of the belt itself, the decay and/or failure of a papermaking belt can also have serious implications on the efficiency of the papermaking process and the paper products so produced. A high frequency of paper machine belt failures can substantially affect the economies of a paper manufacturing business due to the loss of the use of the expensive papermaking machinery (that is, the machine "downtime") during the time a replacement belt is being fitted on the papermaking machine.

Therefore, a need exists for an improved papermaking belt, a method of making a papermaking belt, and an ability to monitor the physical condition of a papermaking belt during use in the production of paper products that can eliminate the foregoing problems. In short, the ability to measure the physical condition of the papermaking belt made by the prior processes during use can provide for real-time in situ feedback into the papermaking process that can stimulate process changes necessary to produce quality paper products and simultaneously increase papermaking belt life.

SUMMARY OF THE INVENTION

The present disclosure provides for a method of making a papermaking belt. The papermaking belt has a reinforcing structure and a framework. The method comprises the steps of: (a) providing a reinforcing structure having a paper-facing side, a machine-facing side opposite the paper-facing side, interstices and a reinforcing component comprised of a plurality of structural components; (b) providing a first portion of the reinforcing component with a measuring device, the measuring device being disposed upon the first portion of the reinforcing component; and, (c) coating the at least one side of the reinforcing structure with a material so that the material forms a first surface and a second surface, the material being distributed so that the paper-facing side of the reinforcing structure and the measuring device is positioned between the first and second surfaces of the material.

The present disclosure also provides for a method of making a papermaking belt. The papermaking belt comprises a reinforcing structure and a framework. The method comprises the steps of: (a) providing a reinforcing structure having a paper-facing side, a machine-facing side opposite the paper-facing side, interstices and a reinforcing component comprised of a plurality of structural components; (b) providing a first portion of the reinforcing component with a measuring device, the measuring device being disposed within the first portion of the reinforcing component; and, (c) coating the at least one side of the reinforcing structure with a material so that the material forms a first surface and a second surface, the material being distributed so that the paper-facing side of the reinforcing structure and the measuring device is positioned between the first and second surfaces of the material.

The present disclosure further provides for a method of making a papermaking belt. The papermaking belt comprises a reinforcing structure and a framework. The method comprises the steps of: (a) providing a reinforcing structure having a paper-facing side, a machine-facing side opposite the paper-facing side, interstices and a reinforcing component comprised of a plurality of structural components; (b) providing a first portion of the reinforcing component with a measuring device, the measuring device being disposed upon the first portion of the reinforcing component; and, (c) coating the at least one side of the reinforcing structure with a material having at least one measuring device disposed therein so that the material forms a first surface and a second surface, the material being distributed so that the paper-facing side of the reinforcing structure and the measuring device is positioned between the first and second surfaces of the material.

DETAILED DESCRIPTION

In papermaking, the term "machine direction" (MD) refers to that direction which is parallel to the flow of the paper web through the equipment. The "cross-machine direction" (CD) is perpendicular to the machine direction. The "Z-direction" refers to that direction that is orthogonal to both the MD and CD.

The Improved Papermaking Belt

Figure 1:
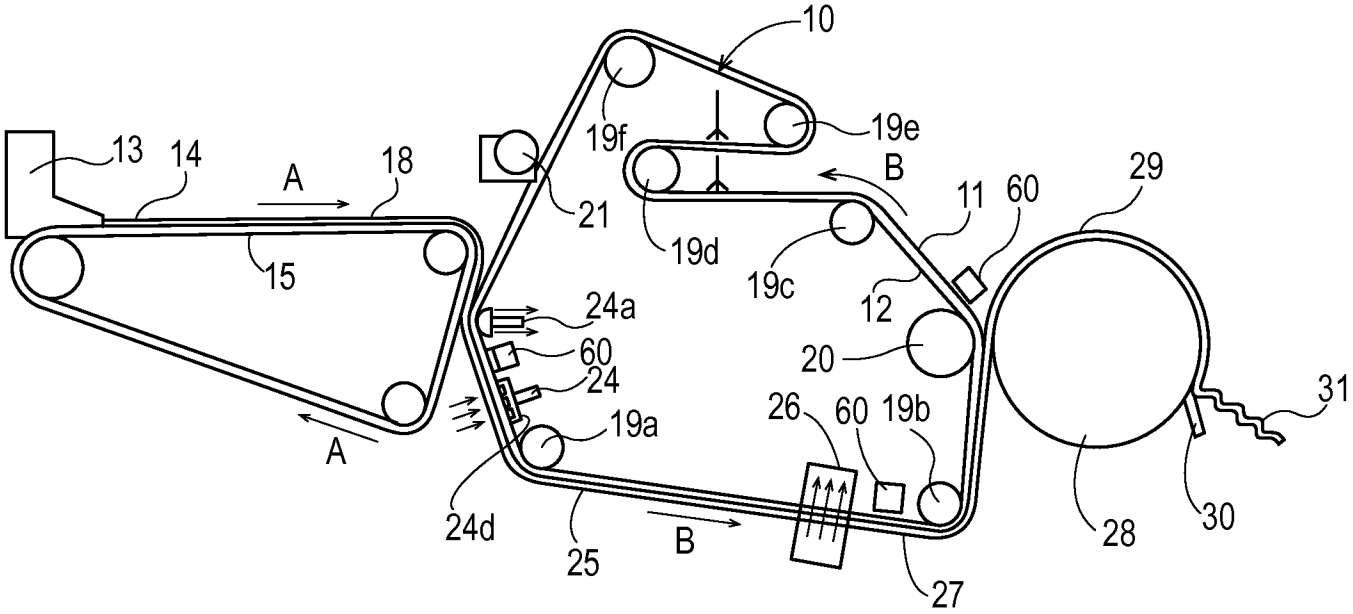
FIG. 1 is a schematic representation of one embodiment of a continuous papermaking machine useful in carrying out the process of this disclosure.

In the representative papermaking machine illustrated in FIG. 1, the papermaking belt 10 (or belt 10) of the present disclosure can take the form of an endless belt. In FIG. 1, the papermaking belt 10 carries a paper web ("fiber web" or the like) in various stages of its formation and travels in the direction indicated by directional arrow B around the papermaking belt return rolls 19*a*, 19*b*, impression nip roll 20, papermaking belt return rolls 19*c*, 19*d*, 19*e* and 19*f*, and emulsion distributing roll 21. The loop the papermaking belt 10 travels around includes a means for applying a fluid pressure differential to the paper web, such as vacuum pickup shoe 24*a* and multi-slot vacuum box 24. In FIG. 1, the papermaking belt can also travel around a pre-dryer such as blow-through dryer 26, and pass between a nip formed by the impression nip roll 20 and a Yankee dryer drum 28. Although an embodiment of the present disclosure is in the form of an endless belt, the present disclosure can be incorporated into numerous other forms.

Figure 2:
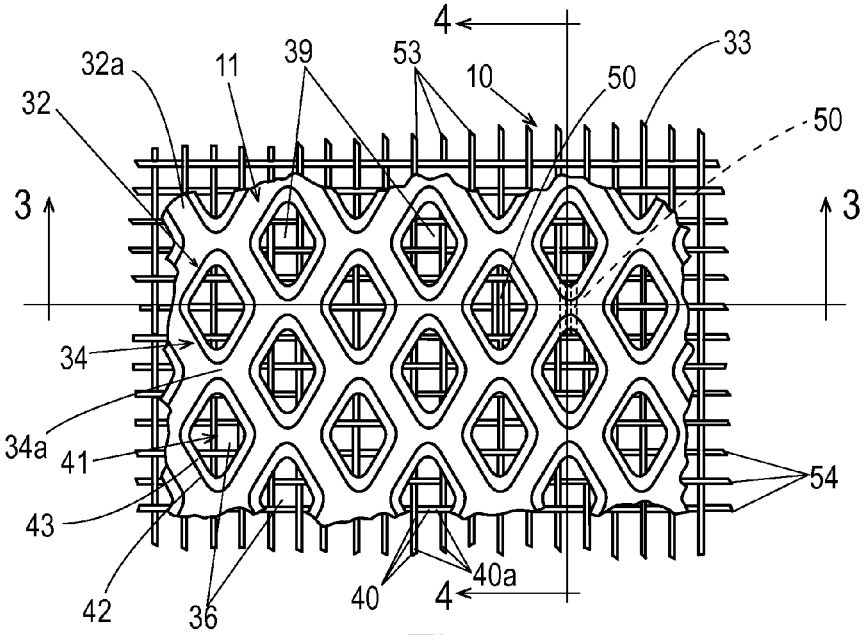
FIG. 2 is a plan view of a portion of an embodiment of the improved papermaking belt of the present disclosure.
Figure 3:
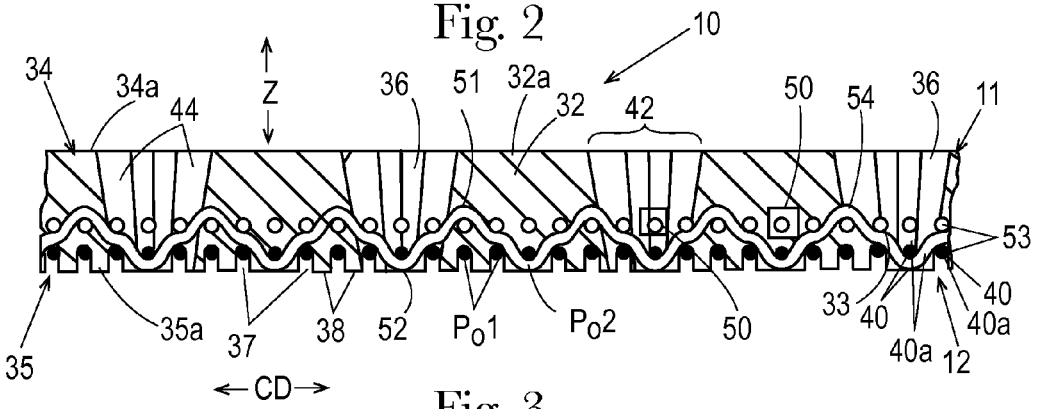
FIG. 3 is an enlarged cross-sectional view of the portion of the improved papermaking belt shown in FIG. 2 taken along line 3-3.
Figure 4:
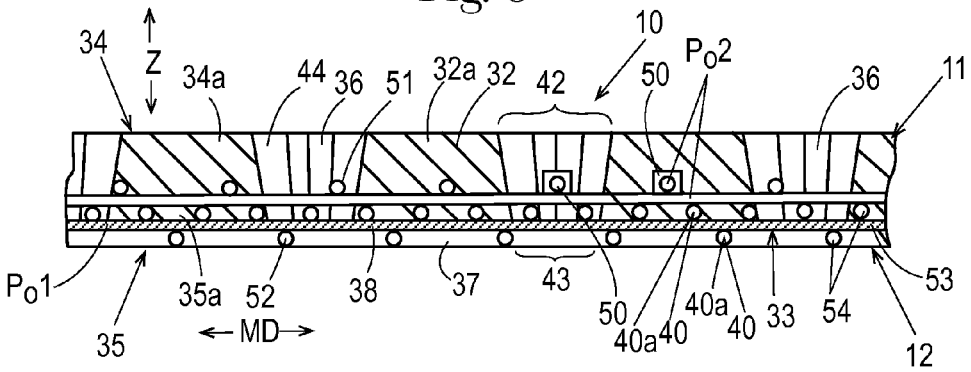
FIG. 4 is an enlarged cross-sectional view of the portion of the improved papermaking belt shown in FIG. 2 taken along line 4-4.

The overall characteristics of the papermaking belt 10 of the present disclosure are shown in FIGS. 2-4. The papermaking belt 10 of the present disclosure is generally comprised of two primary elements: a framework 32 and a reinforcing structure 33. In one non-limiting example, framework 32 can be a hardened polymeric photosensitive resin. In one embodiment, the papermaking belt 10 is provided as an endless belt having two opposed surfaces which are referred to herein as the paper-contacting side 11 and a textured backside or simply, backside 12. The backside 12 of the papermaking belt 10 contacts the machinery employed in the papermaking operation, such as vacuum pickup shoe 24*a* and multi-slot vacuum box 24. The framework 32 has a first surface 34, a second surface 35 opposite the first surface 34, and conduits 36 extending between the first surface 34 and the second surface 35. The first surface 34 of the framework 32 contacts the fiber webs to be dewatered, and defines the paper-contacting side 11 of the belt. The conduits 36 extending between the first surface 34 and the second surface 35 channel water from the fiber web that rests on the first surface 34 to the second surface 35 and provides areas into which the fibers of the fiber web can be deflected into and rearranged. FIG. 2 shows that the network 32*a* can comprise the solid portion of the framework 32 that surrounds the conduits 36 to define a net-like pattern.

As shown in FIG. 2, the openings 42 of the conduits 36 can be arranged in a preselected pattern in the network 32*a*. FIG. 2 shows that the first surface 34 of the framework 32 has a paper side network 34*a* formed therein which surrounds and defines the openings 42 of the conduits 36 in the first surface 34 of the framework 32. The second surface 35 of the framework 32 has a backside network 35*a* that surrounds and defines the openings 43 of the conduits 36 in the second surface 35 of the framework 32. FIGS. 3-4 provide that the reinforcing structure 33 of the papermaking belt 10 is at least partially surrounded by, enveloped, embedded, and/or encased within the framework 32. More specifically, the reinforcing structure 33 is positioned between the first surface 34 of the framework 32 and at least a portion of the second surface 35 of the framework 32. FIGS. 3 and 4 also show that the reinforcing structure 33 has a paper-facing side 51 and a machine-facing side 52 opposed thereto. As shown in FIG. 2, the reinforcing structure 33 has interstices 39 and a reinforcing component 40. The reinforcing component 40 comprises the portions of the reinforcing structure exclusive of the interstices 39 (that is, the solid portion of the reinforcing structure 33). A plurality of measurement device(s) 50 (also referred to herein as measuring device(s) 50) can be disposed within the framework 32 and can be incorporated into or upon the reinforcing structure 33. Measurement devices 50, their incorporation into a papermaking belt, and their usefulness will be discussed infra.

The reinforcing component 40 is generally comprised of a plurality of structural components 40*a*. FIGS. 3-4 show that the second surface 35 of the framework 32 has a backside network 35*a* with a plurality of passageways 37. The passageways 37 allow air to enter between the backside surface 12 of the papermaking belt 10 and the surfaces of the vacuum dewatering equipment employed in the papermaking process (such as vacuum pickup shoe 24*a* and vacuum box 24) when a vacuum is applied by the dewatering equipment to the backside 12 of the belt to deflect the fibers into the conduits 36 of the belt 10.

The paper-contacting side 11 of the belt 10 shown in FIGS. 1-4 is the surface of the papermaking belt 10 which contacts the paper web which is to be dewatered and rearranged into the finished product. The paper-contacting side 11 of the belt 10 may also be referred to as the "embryonic web-contacting surface" of the belt 10. As shown in FIGS. 2-4, the paper-contacting side 11 of the belt 10 is generally formed entirely by the first surface 34 of the framework 32.

As shown in FIG. 1, the backside 32 is the surface which travels over and is generally in contact with the papermaking machinery employed in the papermaking process.

Figure 5:
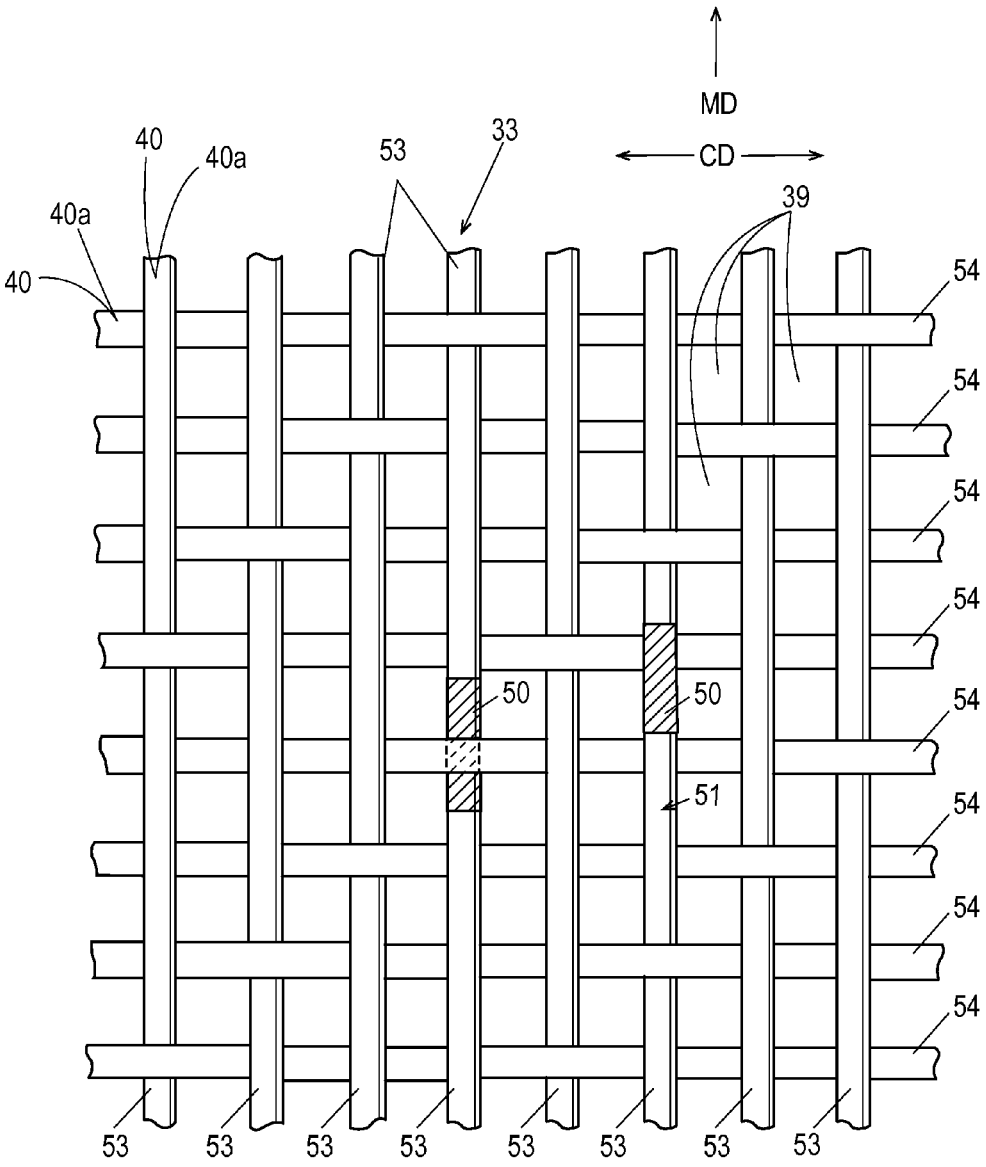
FIG. 5 is an enlarged plan view of a portion of an exemplary woven multi-layer reinforcing structure suitable for use with the improved papermaking belt.

The reinforcing structure 33 is shown in FIGS. 2-4 and in isolation in FIG. 5. The reinforcing structure 33 strengthens the resin framework 32 and has suitable projected open area to allow the vacuum dewatering machinery employed in the papermaking process to adequately perform its function of removing water from partially-formed webs of paper and to permit water removed from the paper web to pass through the papermaking belt 10. The reinforcing structure 33 can comprise a woven element (also sometimes referred to herein as a woven "fabric"), a nonwoven element, a screen, a net (for instance, thermoplastic netting), a scrim, or a band or plate (made of metal or plastic or other suitable material) with a plurality of holes punched or drilled in it provided the reinforcing structure 33 adequately reinforces the framework 32 and has sufficient projected open area. Preferably, the reinforcing structure 33 comprises a foraminous woven element.

Generally, as shown in FIGS. 2-5, the reinforcing structure 33 comprises a reinforcing component 40 and a plurality of interstices 39. The reinforcing component 40 is the portion of the reinforcing structure 33 exclusive of the interstices 39. In other words, the reinforcing component 40 is the solid portion of the reinforcing structure 33. The reinforcing component 40 is comprised of one or more structural components 40*a*. "Structural components" refers to the individual structural elements that comprise the reinforcing structure 33.

The interstices 39 allow fluids (e.g., water removed from the paper web) to pass through the belt 10. The interstices 39 may form any pattern in the reinforcing structure 33. The pattern formed by the interstices 39 should be contrasted with the preselected pattern formed by the conduit openings.

As shown in FIGS. 3-4, the reinforcing structure 33 has two sides. These are the paper-facing side (or "paper support side") 51 that faces the fiber webs to be dewatered, and the machine-facing side (or "roller contact side") generally designated 52 opposing the paper-facing side. As shown in FIGS. 3 and 4, the reinforcing structure 33 is positioned between the first surface 34 of the framework 32 and at least a portion of the second surface 35 of the framework 32.

The structural components 40*a* of a woven reinforcing structure can comprise yarns, strands, filaments, or threads. It is also to be understood that the above terms (yarns, strands, etc.) could comprise not only monofilament elements, but also multifilament and/or multi-component (e.g., bi-component) elements. Many types of woven elements are suitable for use as a reinforcing structure 33 in the papermaking belt 10 of the present disclosure. Suitable woven elements include foraminous monolayer woven elements (having a single set of strands running in each direction and a plurality of openings therebetween) such as the reinforcing structure 33 shown in FIG. 5.

The papermaking belt 10 comes under considerable stress in the machine direction due to the repeated travel of the belt 10 over the papermaking machinery in the machine direction and also due to the heat transferred to the belt by the drying mechanisms employed in the papermaking process. Such heat and stress can cause the papermaking belt to stretch. If the papermaking belt 10 stretches significantly, its ability to serve its intended function of carrying a paper web through the papermaking process can become diminished to the point of uselessness. If significant tension is applied to the papermaking belt 10 during manufacture of the papermaking belt 10 itself or during use of the papermaking belt 10 on a paper machine, mechanical failure can occur (i.e., the belt can rip or can be caused to sufficiently narrow (Poisson effect)).

To be suitable for use as a reinforcing structure, a multilayer woven element preferably has some type of structure that provides for reinforcement of the machine direction yarns 53. In other words, the multilayer fabric should have increased fabric stability in the machine-direction.

As shown in FIGS. 2-5, a preferred reinforcing structure 33 is a multilayer woven element that has a single layer yarn system with yarns which extend in a first direction and a multiple layer yarn system with yarns which extend in a second direction normal to the first direction. In the preferred reinforcing structure 33, the first direction is the cross-machine direction. The yarns that extend in the first direction comprise the weft yarns 54. The multiple layer yarn system extends in the machine direction. Fabrics having multiple machine direction warp yarns are preferred, however, because the additional strands run in the direction which is generally subject to the greatest stresses.

While the specific materials of construction of the warp yarns and weft yarns can vary, the material comprising the yarns should be such that the yarns will be capable of reinforcing the resinous framework and sustaining stresses as well as repeated heating and cooling without excessive stretching. Suitable materials from which the yarns can be constructed include polyesters, polyamides, high heat resistant materials such as KEVLAR™, NOMEX™, combinations thereof, and any other materials which are known for use in papermaking fabrics.

Any convenient cross-sectional dimensions (or size) of the yarns can be used as long as the flow of air and water through the conduits 36 is not significantly hampered during the paper web processing and as long as the integrity of the papermaking belt 10 maintained. The cross-sectional shapes of the yarns in the different layers and yarn systems can also vary between the layers and yarn systems.

The reinforcing structure 30 can have a first portion $P_{01}$ of the reinforcing component 40 that has a first opacity $\mathbf{0}_1$, and a second portion $P_{02}$ of the reinforcing component 40 that has a second opacity $\mathbf{0}_2$. The two opacities $\mathbf{0}_1$ and $\mathbf{0}_2$ can be related such that the second opacity $\mathbf{0}_2$ is less (that is, relatively less opaque) than the first opacity $\mathbf{0}_1$. The first opacity $\mathbf{0}_1$ should be sufficient to substantially prevent the curing of a photosensitive resinous material, if such a material is used to form the framework 32, when that photosensitive resinous material is in its uncured state and the first portion $P_{01}$ is positioned between the photosensitive resinous material and a source of actinic radiation.

The framework 32 can be formed by manipulating a mass of material, generally in liquid form, so that the material, when in solid form, at least partially surrounds the reinforcing structure 33 so that the reinforcing structure 33 is positioned between the first surface 34 and at least a portion of the second surface 35 of the framework 32. The material can be manipulated so that the framework 32 has a plurality of conduits 36 or channels that extend between the first surface 34 and the second surface 35 of the framework 32. The material can also be manipulated so that the first surface has a paper side network 34*a* formed therein which surrounds and defines the openings of the conduits 36 in the first surface 34 of the framework 12. In addition, the material can be manipulated so that the second surface 35 of the framework 32 has a backside network 35*a* with passageways 37, distinct from the conduits 36.

The mass of material which is manipulated to form the framework 32 can be any suitable material, including thermoplastic resins and photosensitive resins, but the preferred material for use in forming the framework 32 of the present disclosure is a liquid photosensitive polymeric resin. Likewise, the material chosen can be manipulated in a wide variety of ways to form the desired framework 32, including mechanical punching or drilling, curing the material by exposing it to various temperatures or energy sources, or by using a laser to cut conduits. The method of manipulating the material which will form the framework 32, of course, can depend on the material chosen and the characteristics of the framework 32 desired to be formed from the mass of material. Preferably, the photosensitive resin is manipulated by controlling the exposure of the liquid photosensitive resin to light of an activating wavelength.

Since the reinforcing structure 33 is positioned between the first surface 34 and at least a portion of the second surface 35 of the framework 32, the second surface 35 of the framework 32 can either, completely cover the reinforcing structure 33, cover only a portion of the reinforcing structure 33 or, cover no portions of the reinforcing structure 33 and lie entirely within the interstices 39 of the reinforcing structure 33.

The conduits 36 have a channel portion 41 which lies between the conduit openings 42 and 43. These channel portions 41 are defined by the walls 44 of the conduits 36. FIGS. 2-4 show that the holes or channels 41 formed by the conduits 36 extend through the entire thickness of the papermaking belt 10. In addition, as shown in FIG. 2, the conduits 36 are generally discrete. By "discrete", it is meant that the conduits 36 form separate channels, which are separated from each other by the framework 32. The conduits 36 are described as being "generally" discrete, however, because the conduits 36 may not be completely separated from each other along the second surface 35 of the framework 32 when passageways 37 are present in the backside network 35*a*.

It is preferred that the passageways 37 and the irregularities 38 are distinct from the conduits 36 which pass through the framework 32. By "distinct" from the conduits, it is meant that the passageways 37 and the irregularities 38 which comprise departures from the otherwise smooth and continuous backside network 35*a* of the framework 32 are to be distinguished from the holes 41 formed by the conduits 36. In other words, the holes 41 formed by the conduits 36 are not intended to be classified as passageways or surface texture irregularities.

Referring again to FIG. 1, belt 10 carries an embryonic web 18 on the first surface. As shown, a portion of belt 10 passes over a single slot 24*d* of a vacuum box 24. In operation, a vacuum is applied from a vacuum source (not shown), which exerts pressure on the belts and the embryonic webs 18 in the direction of the arrows shown. The vacuum removes some of the water from the embryonic web 18 and deflects and rearranges the fibers of the embryonic web into the conduits 36 of the framework 32.

The measurement devices 50 and an associated reading device 60 (also referred to herein as receiver 60) (the receiver 60 being efficaciously disposed about the papermaking process) are preferably configured to measure or monitor any physical characteristics of the papermaking belt 10 during the manufacture of paper products. The measurement devices 50 may also be configured to measure and monitor physical characteristics for controlling and monitoring the papermaking process. The characteristics that can be measured can include, e.g. belt temperature, belt deformation (e.g., tension, compression, bending moment, stress, and/or strain), belt and/or process pressure, belt acceleration (vibration), moisture, speed, pH, and the like. The measurement devices 50 may transmit measurement data when proximate to the receiver 60, which may further communicate any measurement data to a control unit and/or a data acquisition system capable of processing and/or storing such measurement data. The measurement devices 50 may comprise a transmitter or a transceiver for communicating the measurement data wirelessly to a receiver 60. The measurement devices 50 may be remotely-read untouchably by receiver 60 by means of electromagnetic radiation. Depending on the wavelength, the electromagnetic radiation used can include: radio waves, microwaves, infrared radiation, light, ultraviolet radiation, X-ray radiation, gamma radiation, and the like. Exemplary and suitable measurement devices can include those developed by the Wireless Identification and Sensing Platform of the University of Washington. Suitable reading devices 60 are the model S9028PCL UHF receiver manufactured by Laird Technologies.

Additionally, measurement devices 50 can be provided as microelectromechanical (MEMS), nanoelectromechanical (NEMS) systems, combinations thereof, and the like. Both MEMS and NEMS can be formed from graphene, at least in part, although other materials may be used alternatively as would be understood by those of skill in the art. As would be understood by one of skill in the art, graphene is a single atomic layer of carbon and is the strongest material known to man (where strength is not to be confused with hardness). It also has electrical properties superior to the silicon used to make the chips found in modern electronics. The combination of these properties can make graphene an ideal material for nanoelectromechanical systems, which are scaled-down versions of microelectromechanical systems used for sensing any physical characteristics and any physical phenomena including but not limited to temperature, vibration, and acceleration experienced by papermaking belt 10 during use.

Due to the continuous shrinking of electrical circuits, particularly those involved in creating and processing radio-frequency signals, they are harder to miniaturize. These 'off-chip' components can take up a lot of space and electrical power in comparison to the overall size of ultra-small systems. In addition, most of these radio wave-related components cannot be easily tuned in frequency, requiring multiple copies to ensure the range of frequencies used for wireless communication is covered. Graphene NEMS can address both problems in that they are compact and easily integrated with other types of electronics. Further, their frequency can be tuned over a wide range of frequencies because of the tremendous mechanical strength of graphene.

The measurement devices 50 may also comprise identification information, such as a code, an ID number, or the like. In addition to identification information, measurement devices 50 may comprise at least one other piece of information, which can include papermaking belt type number, manufacturer information, order information, date, order number or any other information that can be utilized during the installation, use, maintenance, manufacture, or quality control of the papermaking belt 10 or for ordering new papermaking belts 10. The measurement devices 50 may comprise at least one memory wherein, in addition to the identification information, at least one piece of additional information (such as any physical characteristics of papermaking belt 10 measured during use) may be stored. The information stored in the memory can be changed during the process, during repair or washing of the belt 10, as well as during storage thereof.

The data obtained from the measurement devices 50 may be utilized in controlling the papermaking process, choosing an appropriate belt for a papermaking process, clearing failures during the manufacture of products, as well as in choosing papermaking process operating parameters. Such an enhanced data acquisition system may thus significantly improve the efficiency and efficacy of the papermaking process as well as the papermaking belt 10 itself. Collected data can be forwarded from the data acquisition system for managing the production of, the use of, and/or the storage of the belts 10 as well as monitoring any necessary papermaking process conditions during the production of paper products that use papermaking belt 10.

The measurement device 50 may comprise a tag responding to radio-frequency electromagnetic radiation. Identification distances and wave transmittivity, for instance, may be influenced by using different radio frequencies. The data acquisition system may further utilize tags responding to different frequencies of different sensors that can be used for measurement devices 50 (e.g., temperature, belt deformation, belt and/or process pressure, and the like). Additionally, the measurement devices 50 may comprise a tag, a transponder containing an antenna for receiving radio-frequency electromagnetic radiation as well as a microchip wherein the identification information is stored. Further, the measurement devices 50 may comprise a so-called Radio Frequency Identification (RFID) tag. The tag can be extremely small thereby making it easier to position within or upon the belt 10. Such RFID tags are inexpensive, reliable, and highly available.

Measurement device 50 can be a passive RFID tag which comprises no power source of its own but the extremely low electric current required by its operation is induced by radio-frequency scanning received by the antenna contained within measurement device 50 and transmitted by the receiver 60. By means of this induced current, the tag is able to transmit a response to an inquiry sent by the reading device. In other words, the reading device searches through (e.g., scans) the environment for a tag, and the tag transmits, for example, a measured physical characteristic of papermaking belt 10, any ID code, and/or any other relevant and/or necessary information stored in the microchip (response) after the scanning has induced thereto the electric current necessary for the transmission. The RFID tag may be read at a radio frequency without visual communication and it may be read even through obstacles. In addition, exemplary RFID readers can read a plurality of measurement devices 50, such as RFID tags, simultaneously.

The measurement devices 50 may comprise one or more portable electronic terminal devices suitable as a reading device 60. The reading device 60 may be a data acquisition device, portable computer, palmtop computer, mobile telephone or another electronic device provided with the necessary means for remote-reading a tag. The reading device 60 may comprise a control unit included in the monitoring system.

By way of non-limiting example, measurement devices 50 can comprise thermocouples for measuring the temperature of the papermaking belt 10. Alternatively, the measurement device 50 could comprise a strain gauge sensor that would be suitable for measuring the bending moment, tension, stress, and/or strain present within papermaking belt 10. Yet still, measurement device 50 could be provided as a pressure sensor, a pH sensor, or even a wear (i.e., erosion) gauge.

If measurement device 50 is provided as a thermocouple, a thermocouple suitable for use as a measurement device 50 could be woven into the reinforcing structure 33. Alternatively, the measurement device 50 could be disposed upon the reinforcing structure 33 and/or affixed to the reinforcing structure 33 by needlework or by way of adhesive. Further, measurement device 50 could be printed onto the reinforcing structure 33 using 3D-printing technology, for example. In any regard, it is preferred that measuring device 50 not have any adverse impact on the overall permeability of the papermaking belt 10.

It is also believed that the measurement device 50 can be woven into the portion of the papermaking belt that is overlapped and re-woven to form a seam that makes papermaking belt 10 an endless loop. If it is chosen to apply the measurement device 50 only at this location on the papermaking belt 10, one of skill in the art will understand that during use of the papermaking belt 10, the result will be suitable measurements taken in a highly periodic fashion. For example, if a papermaking belt is 200 feet in overall length, and during manufacturing is operated at a linear speed of 2,000 feet/minute, the seam portion of papermaking belt 10 having measurement devices 50 disposed therein/thereon, can provide a measurement at any given point in the manufacturing process every 10 seconds.

Alternatively, it is believed that measurement device 50 can be provided as a portion of a bi-component filament material utilized to form reinforcing structure 33. In other words, the measurement device 50 can be arranged as a filament that includes the measurement device 50 (and any associated electronics) as either the inner or outer portion of a coaxially formed bi-component filament or any other type of high performance cable. In this manner, one of skill in the art will recognize that any number of measurement devices 50 can be woven into and incorporated as part of reinforcing structure 33 at any location, or in any number of locations, within the confines of reinforcing structure 33.

Yet still, if measurement device 50 is provided as a MEMS or NEMS (discussed supra), it is believed that one of skill in the art could incorporate such a MEMS or NEMS sensor(s) into the resin used to form the framework 32. In this way a significant number of measurement devices 50 can be incorporated across the papermaking belt 10 in the CD, over its length in the MD, and combinations thereof. Measurement devices 50 can be disposed collinearly, sinusoidally, randomly, or in any fashion across the CD, MD, and combinations thereof. The use of such MEMS and/or NEMS sensors can significantly reduce any effects and/or impact of disposing a measurement device 50 into a papermaking belt 10 by reducing the amount of physical effort necessary to incorporate a measurement device 50 into the reinforcing structure 33 or the framework 32 as well as reduce the impact to the permeability of the papermaking belt 10 due to any portions of the measurement device 10 that may be disposed within a given conduit 36.

Process for Making a Papermaking Belt

As indicated above, the papermaking belt 10 can take a variety of forms. While the method of construction of the papermaking belt 10 is immaterial so long as it has the characteristics required to manufacture paper products, certain methods have been discovered to be useful. One exemplary and non-limiting process for making the improved papermaking belt 10 of the present disclosure is described infra.

Figure 6:
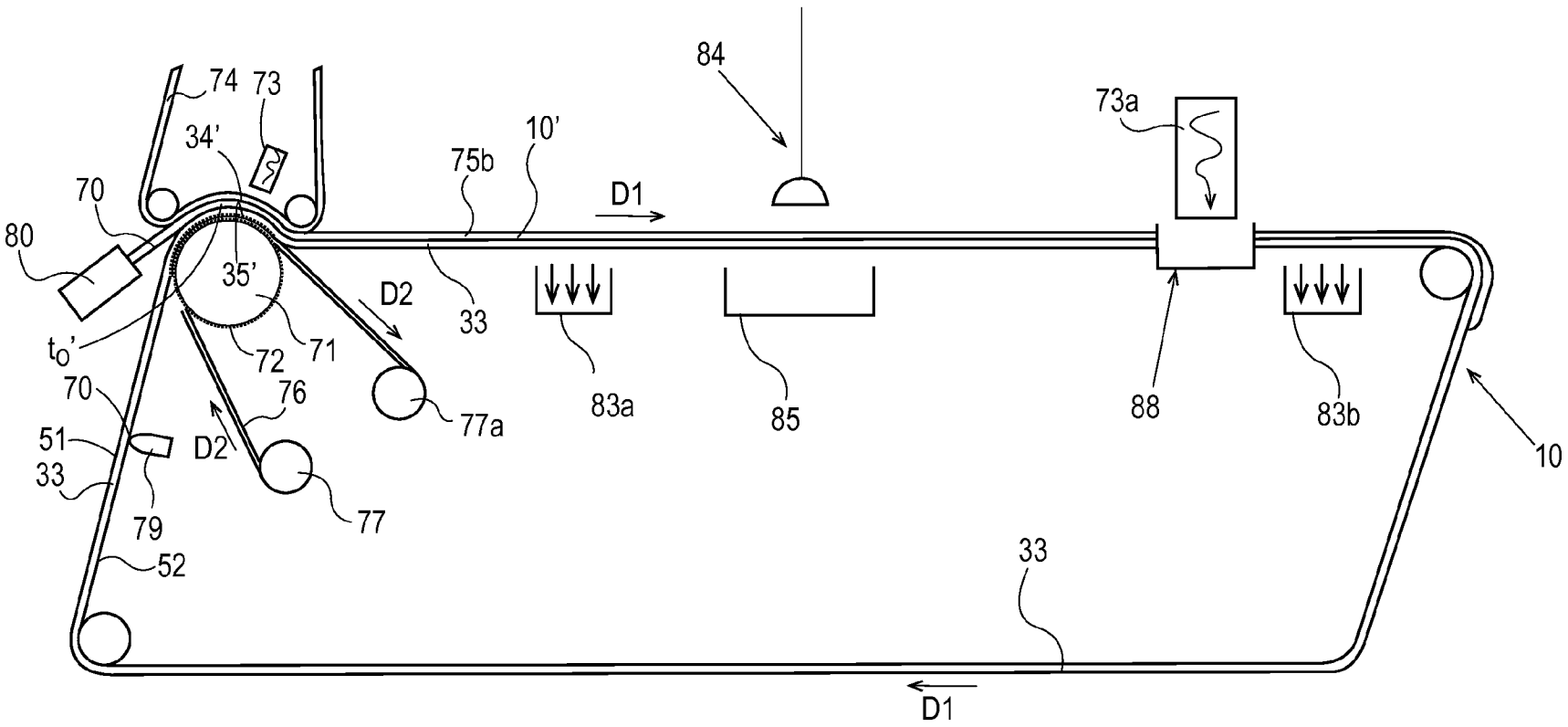
FIG. 6 is a schematic representation of the basic apparatus for making the papermaking belt of the present disclosure.

A preferred embodiment of an apparatus which can be used to construct a papermaking belt 10 of the present disclosure in the form of an endless belt is shown in schematic outline in FIG. 6. In order to show an overall view of the entire apparatus for constructing a papermaking belt in accordance with the present disclosure, FIG. 6 was simplified to a certain extent with respect to some of the details of the process. The details of this apparatus, and particularly the manner in which the passageways 37 and the surface texture irregularities 38 are imparted to the backside network 35*a* of the second surface 35 of the framework 32 are shown in the figures which follow. It should be noted at this point that the scale of certain elements shown may be somewhat exaggerated in the following drawing figures.

The overall process for making the improved papermaking belt 10 generally involves coating a reinforcing structure 33 having measurement devices 50 disposed therein or thereupon with a liquid photosensitive polymeric resin 70 when the reinforcing structure 33 is traveling over a forming unit or table 71 (or "casting surface") 72. Alternatively, a measurement device 50 provided as a MEMS or NEMS could be dispersed within the resin used to coat the reinforcing structure 33.

Figure 7:
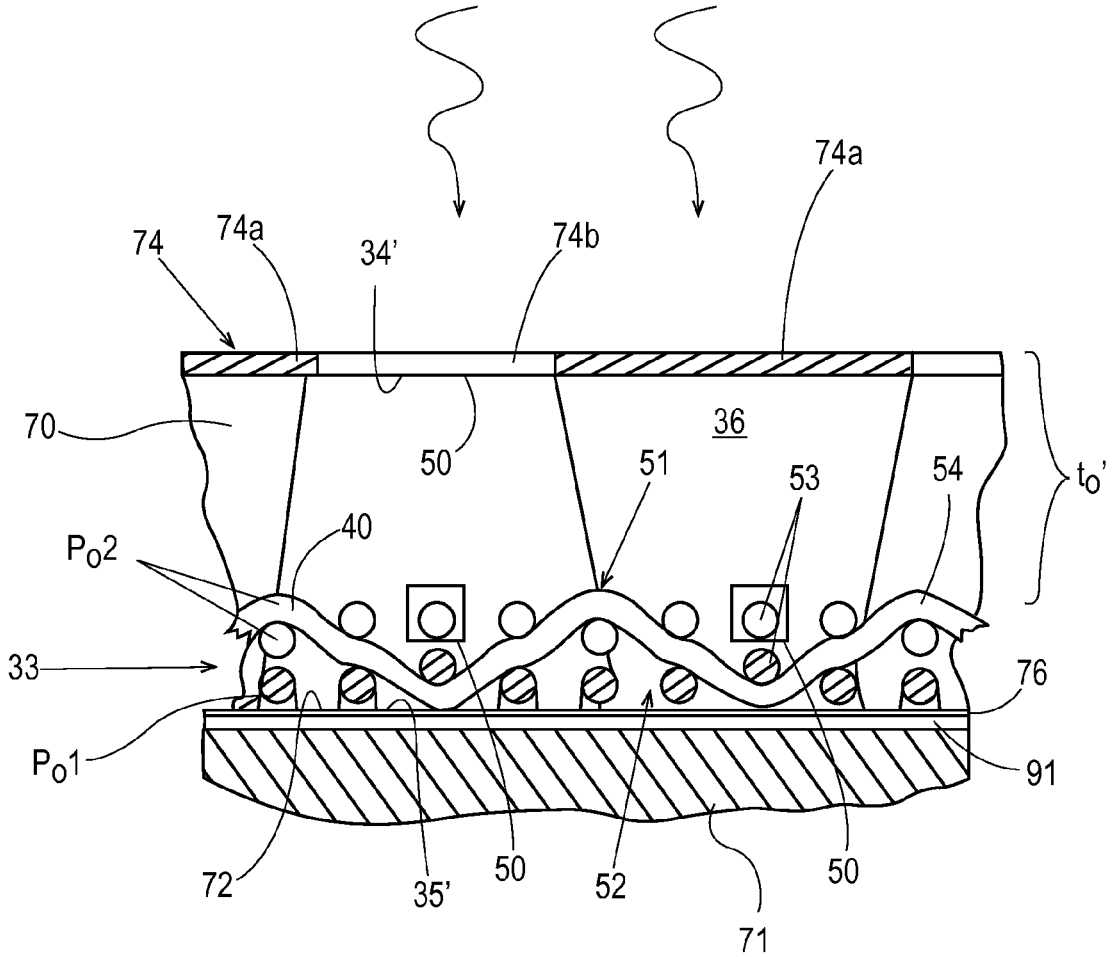
FIG. 7 is an enlarged schematic cross-sectional view of a portion of the casting surface of a process for making the papermaking belt of the present disclosure showing the working surface, barrier film, reinforcing structure, resin, and mask.

As shown in FIG. 6, the resin, or "the coating" 70 (with or without MEMS and/or NEMS) is applied to at least one (and preferably both) sides(s) of the reinforcing structure 33 (with or without a measuring device 50 disposed therein or thereupon) so the coating 70 substantially fills the void areas of the reinforcing structure 33 and forms a first surface 34' and a second surface 35'. The coating 70 is distributed so that at least a portion of the second surface 35' of the coating is positioned adjacent the casting surface 72 of the forming unit 71. The coating 70 is also distributed so that the paper-facing side 51 of the reinforcing structure 33 is positioned between the first and second surfaces 34' and 35' of the coating 70. In addition, as shown in FIG. 7, the coating 70 is distributed so portions of the second surface 35' of the coating are positioned between the opaque first portion $P_{01}$ of the reinforcing component 40 and the working surface 72 of the forming unit 71. The portion of the coating which is positioned between the first surface 34' of the coating and the paper-facing side 51 of the reinforcing structure 33 forms a resinous overburden $t_0'$. The thickness of the overburden $t_0'$ can be controlled to a preselected value.

The liquid photosensitive resin 70 is then exposed to a light having an activating wavelength (light which will cure the photosensitive liquid resin) from a light source 73 through a mask 74 which has opaque regions 74*a* and transparent regions 74*b* and through the reinforcing structure 33. The portions of the resin which have been shielded or protected from light by the opaque regions 74*a* of the mask 74 and by the first portion $P_{01}$ of the reinforcing structure 33 are not cured by the exposure to the light. The remaining portions of the resin (the unshielded portions, and those portions that the second portion $P_{02}$ of the reinforcing structure 33 permits the curing of) are cured. The uncured resin is then removed to leave conduits 36 which pass through the cured resin framework 32.

For convenience, the stages in the overall process are broken down into a series of steps and examined in greater detail in the discussion which follows. It is to be understood, however, that the steps described below are intended only to provide an exemplary embodiment and to assist the reader in understanding a method of making the papermaking belt of the present disclosure.

First Step

The first step of the process of the present disclosure is providing a forming unit 71 with a working surface 72. The forming unit 71 has working surface which is designated 72. Preferably, the forming unit 71 is covered by a barrier film 76 which prevents the working surface 72 from being contaminated with resin. The barrier film 76 also facilitates the removal of the partially completed papermaking belt 10' from the forming unit 71. Generally, the barrier film 76 can be any flexible, smooth, planar material such as polypropylene, polyethylene, or polyester sheeting. Preferably, the barrier film 76 also either absorbs light of the activating wavelength, or is sufficiently transparent to transmit such light to the working surface 72 of the forming unit 71, and the working surface 72 absorbs the light.

The barrier film 76 contacts the working surface 72 of forming unit 71 and is temporarily constrained against the working surface 72. The barrier film 76 travels with the forming unit 71 as the forming unit 71 rotates. The barrier film 76 is eventually separated from the working surface 72 of the forming unit 71. Preferably, the forming unit 71 is also provided with a means for insuring that barrier film 76 is maintained in close contact with its working surface 72. Preferably, the barrier film 76 is held against the working surface 72.

Second Step

The second step of the process of the present disclosure is providing a reinforcing structure 33, for incorporation into the papermaking belt. FIG. 7 shows that the reinforcing structure 33 has a paper-facing side 51, a machine-facing side 52 opposite the paper-facing side 51, interstices 39, and a reinforcing component 40 comprised of a plurality of structural components 40*a*. A first portion $P_{01}$ of the reinforcing component 40 can have a first opacity $\mathbf{0}_1$ and a second portion $P_{02}$ of the reinforcing component 40 can have a second opacity $\mathbf{0}_2$ less than the first opacity $\mathbf{0}_1$. The first opacity $\mathbf{0}_1$ is preferably sufficient to substantially prevent curing of the photosensitive resinous material when the photosensitive resinous material is in its uncured state and the first portion is positioned between the photosensitive resinous material and an actinic light source 73. The second opacity $\mathbf{0}_2$ is preferably sufficient to permit curing of the photosensitive resinous material. Preferably, the reinforcing structure 33 is a woven, multilayer fabric.

If a measurement device 50 is provided, it could be woven into the reinforcing structure 33. Alternatively, the measurement device 50 could be disposed upon the reinforcing structure 33 and/or affixed to the reinforcing structure 33 by needlework or by way of adhesive. Further, measurement device 50 could be printed onto the reinforcing structure 33 using 3D-printing technology, for example.

It is also believed that the measurement device 50 can be woven into the portion of the papermaking belt that is overlapped and re-woven to form a seam that makes papermaking belt 10 an endless loop. Alternatively, it is believed that measurement device 50 can be provided as a portion of a bi-component filament material utilized to form reinforcing structure 33. In other words, the measurement device 50 can be arranged as a filament that includes the measurement device 50 (and any associated electronics) as either the inner or outer portion of a coaxially formed bi-component filament or any other type of high performance cable. In this manner, one of skill in the art will recognize that any number of measurement devices 50 can be woven into and incorporated as part of reinforcing structure 33 at any location, or in any number of locations, within the confines of reinforcing structure 33.

Since the preferred papermaking belt 10 is in the form of an endless belt, the reinforcing structure 33 should also be an endless belt since the papermaking belt 10 is constructed around the reinforcing structure 33. As illustrated in FIG. 6, the reinforcing structure 33 which has been provided is arranged so that it travels in the direction indicated by directional arrow D1. It is to be understood that in the apparatus used to make the papermaking belt of the present disclosure, there are conventional guide rolls, return rolls, drive means, support rolls and the like which are not shown or identified with specificity in FIG. 6.

Third Step

The third step in the process of the present disclosure is bringing at least a portion of the machine-facing side 52 of the reinforcing structure 33 into contact with the working surface 72 of the forming unit 71 (or more particularly in the case of the embodiment illustrated, traveling the reinforcing structure 33 over the working surface 72 of the forming unit 71). At least a portion of the machine-facing side 52 of the reinforcing structure 33 is brought into contact with the barrier film 76 so that the barrier film 76 is interposed between the reinforcing structure 33 and the forming unit 72.

Fourth Step

The fourth step in the process is applying a coating of liquid photosensitive resin 70 to at least one side of the reinforcing structure 33 having the measurement devices 50 incorporated therein or disposed thereupon. Generally, the coating 70 is applied so that the coating 70 substantially fills the void areas 39*a* of the reinforcing structure 33 (the void areas are defined below). The coating 70 is also applied so that it forms a first surface 34' and a second surface 35'. The coating 70 is distributed so that at least a portion of the second surface 35' of the coating 70 is positioned adjacent the working surface 72 of the forming unit 71. The coating 70 is distributed so that the paper-facing side 51 of the reinforcing structure 33 is positioned between the first and second surfaces 34' and 35' of the coating 70. The portion of the coating which is positioned between the first surface 34' of the coating and the paper-facing side 51 of the reinforcing structure 33 forms a resinous overburden $t_0'$. The coating 70 is also distributed so that portions of the second surface 35' of the coating 70 are positioned between the first portion $P_{01}$ of the reinforcing component 40 and the working surface 72 of the forming unit 71.

Suitable photosensitive resins can be readily selected from the many available commercially. Resins which can be used are materials, usually polymers, which cure or cross-link under the influence of actinic radiation, usually ultraviolet (UV) light. Such a resin can be provided with measurement devices 50 provided as NEMS contained therein.

The application of resin 70 by the extrusion header 79 is employed in conjunction with the application of a second coating of liquid photosensitive resin 70 at a second stage by a nozzle 80 located adjacent to the place where the mask 74 is introduced into the system. The nozzle 80 applies the second coating of liquid photosensitive resin 70 to the paper-facing side 51 of the reinforcing structure 33. It is necessary that liquid photosensitive resin 70 be evenly applied across the width of reinforcing structure 33 and that the requisite quantity of material be worked through interstices 39 to substantially fill the void areas 39*a* of the reinforcing structure 33.

It is also believed that the measurement device 50 can be placed into a portion of the resin that has been applied to the papermaking belt 10. In other words, the measurement device 50 can be pushed into the resin forming the papermaking belt so that the resin can envelop the measurement device 50 prior to any curing process. In this way, the measurement device 50 (and any associated electronics) can be incorporated at any location, or in any number of locations, within the confines of papermaking belt 10.

Fifth Step

The fifth step involves control of the thickness of the overburden $t_0'$ of the resin coating 70 to a preselected value. In the preferred embodiment of the belt making apparatus shown in the drawings, this step takes place at approximately the same time, i.e., simultaneously, with the second stage of applying a coating of liquid photosensitive resin to the reinforcing structure 33. The preselected value of the thickness of the overburden corresponds to the thickness desired for the papermaking belt 10 and follows from the expected use of the papermaking belt 10.

Sixth Step

The sixth step in the process of this disclosure can be considered as either a single step or as two separate steps which comprise: (1) providing a mask 74 having opaque 74*a* and transparent regions 74*b* in which the opaque regions 74*a* together with the transparent regions 74*b* define a preselected pattern in the mask; and (2) positioning the mask 74 between the coating of liquid photosensitive resin 70 and an actinic light source 73 so that the mask 74 is in contacting relation with the first surface 34' of the coating of liquid photosensitive resin 70. The purpose of the mask 74 is to protect or shield certain areas of the liquid photosensitive resin 70 from exposure to light from the actinic light source. It follows that if certain areas are shielded, it follows that any liquid photosensitive resin 70 in those areas that are not shielded will be exposed later to activating light and will be cured.

The mask 74 can be made from any suitable material which can be provided with opaque regions 74*a* and transparent regions 74*b*. A material in the nature of a flexible photographic film is suitable for use as a mask 74. The flexible film can be polyester, polyethylene, or cellulosic or any other suitable material. The opaque regions 74*a* should be opaque to light which will cure the photosensitive liquid resin. The opaque regions 74*a* can be applied to mask 74 by any convenient means such as by a blue printing (or ozalid processes), or by photographic or gravure processes, flexographic processes, or rotary screen printing processes.

It should be understood that if one of skill in the art provides the measurement devices 50 as MEMS and/or NEMS, one could incorporate the measurement devices 50 into the treatments and/or solutions used to create the mask 74. This could allow for the measurement devices 50 to be effectively transferred to the surface of the resulting papermaking belt 10. In this case it would be preferred that such a measurement device 50 be transparent to the actinic radiation used in the curing process so not to interfere with the resin curing process.

Seventh Step

The seventh step of the process of this disclosure comprises curing the unshielded portions of liquid photosensitive resin in those regions left unprotected by the transparent regions 74*b* of the mask 74 and curing those portions of the coating 70 that the second portion $P_{02}$ of the reinforcing structure 33 permits the curing of, and leaving the shielded portions and those portions of the coating positioned between the first portion $P_{01}$ of the reinforcing structure 33 and the working surface 72 of the forming unit 71 uncured by exposing the coating of liquid photosensitive resin 70 to light of an activating wavelength from the light source 73 through the mask 74. When the barrier film 76 and the reinforcing structure 33 are still adjacent the forming unit 71, the liquid photosensitive resin 70 is exposed to light of an activating wavelength which is supplied by an exposure lamp 73.

The exposure lamp 73, in general, is selected to provide illumination primarily within the wavelength which causes curing of the liquid photosensitive resin 70. That wavelength is a characteristic of the liquid photosensitive resin 70. Any suitable source of illumination, such as mercury arc, pulsed xenon, electrode-less, and fluorescent lamps, can be used. As described above, when the liquid photosensitive resin 70 is exposed to light of the appropriate wavelength, curing is induced in the exposed portions of the resin 70. Curing is generally manifested by a solidification of the resin in the exposed areas. Conversely, the unexposed regions remain fluid. The intensity of the illumination and its duration depend upon the degree of curing required in the exposed areas.

In the preferred embodiment of the present disclosure, the angle of incidence of the light is collimated to better cure the photosensitive resin in the desired areas, and to obtain the desired angle of taper in the walls 44 of the finished papermaking belt 10. Other means of controlling the direction and intensity of the curing radiation, include means which employ refractive devices (i.e., lenses), and reflective devices (i.e., mirrors). The preferred embodiment of the present disclosure employs a subtractive collimator (i.e., an angular distribution filter or a collimator which filters or blocks UV light rays in directions other than those desired). Any suitable device can be used as a subtractive collimator. A dark colored, preferably black, metal device formed in the shape of a series of channels through which light directed in the desired direction may pass is preferred. In the preferred embodiment of the present disclosure, the collimator is of such dimensions that it transmits light so the resin network, when cured, has a projected surface area of about 20-50% on the topside of the papermaking belt 10 and about 50-80% on the backside.

Eighth Step

The eighth step in the process in the present disclosure is removing substantially all of the uncured liquid photosensitive resin from the partially-formed composite belt 10' to leave hardened resin framework 32 around at least a portion of the reinforcing structure 33. In this step, the resin which has been shielded from exposure to light is removed from the partially-formed composite belt 10' to provide the framework 32 with a plurality of conduits 36 in those regions which were shielded from the light rays by the opaque regions 74*a* of the mask 74 and passageways 37 that provide surface texture irregularities 38 in the backside network 35*b* of the framework 32.

As shown in FIG. 25, at a point in the vicinity of the mask guide roll 82, the mask 74 and the barrier film 76 are physically separated from the partially-formed composite belt 10'. The composite of the reinforcing structure 33 and the partly cured resin 70 travels to the vicinity of the first resin removal shoe 83*a* where a vacuum is to remove a substantial quantity of the uncured liquid photosensitive resin from the composite belt 10'.

As the composite belt 10' travels farther, it is brought into the vicinity of resin wash shower 84 and resin wash station drain 85 at which point the composite belt 10' is thoroughly washed with water or other suitable liquid to remove essentially all of the remaining uncured liquid photosensitive resin which is discharged from the system through resin wash station drain 85.

The composite belt 10' is then subjected to a second exposure of light of the activating wavelength by post cure UV light source 73*a*. This second exposure, however, takes place when the composite belt 10' is submerged in a bath 88. The process continues until such time as the entire length of reinforcing structure 33 has been treated and converted into the papermaking belt 10. At the second resin removal shoe 83*b*, any residual wash liquid and uncured liquid resin is removed from the composite belt 10' by the application of vacuum.

It is also believed that the measurement device 50 can be placed into any portion of the cured resin remaining on the papermaking belt 10. In other words, a recess can be formed within the confines of the papermaking belt 10 and the measurement device 50 disposed therein. By way of non-limiting example only, a slot can be excised into the surface of the papermaking belt 10 and a measurement device 50 placed within the geometry of the slot so that the measurement device 50 (and any associated electronics) remains disposed below the surface of the papermaking belt 10. Resin can then be applied and cured into the slot so formed thereby covering the measurement devices 50.

The Papermaking Process

The papermaking process which utilizes the improved papermaking belt 10 of the present disclosure is described below, although it is contemplated that other processes may also be used to make the paper products described herein. Returning again to FIG. 1, a simplified, schematic representation of one embodiment of a continuous papermaking machine useful in the practice of the papermaking process of the present disclosure is shown.

First Step

The first step in the practice of the papermaking process of the present disclosure is the providing of an aqueous dispersion of papermaking fibers 14. The aqueous dispersion of papermaking fibers 14 is provided to a head box 13. The aqueous dispersion of papermaking fibers 14 supplied by the head box 13 is delivered to a forming belt, such as the Fourdrinier wire 15 for carrying out the second step of the papermaking process. The Fourdrinier wire 15 is propelled in the direction indicated by directional arrow A by a conventional drive means which is not shown in FIG. 1.

Second Step

The second step in the papermaking process is forming an embryonic web 18 of papermaking fibers on a foraminous surface from the aqueous dispersion 14 supplied in the first step. After the embryonic web 18 is formed, it travels with Fourdrinier wire 15 and is brought into the proximity of a second papermaking belt, the papermaking belt 10 of the present disclosure.

Third Step

The third step in the papermaking process is contacting (or associating) the embryonic web 18 with the paper-contacting side 11 of the papermaking belt 10 of the present disclosure. The purpose of this third step is to bring the embryonic web 18 into contact with the paper-contacting side of the papermaking belt 10 on which the embryonic web 18, and the individual fibers therein, will be subsequently deflected, rearranged, and further dewatered. The Fourdrinier wire 15 brings the embryonic web 18 into contact with, and transfers the embryonic web 18 to the papermaking belt 10 of the present disclosure in the vicinity of vacuum pickup shoe 24*a*.

As illustrated in FIG. 1, the papermaking belt 10 of the present disclosure travels in the direction indicated by directional arrow B. The papermaking belt 10 passes around return rolls 19*a* and 19*b*, impression nip roll 20, return rolls 19*c*, 19*d*, 19*e* and 19*f*, and emulsion distributing roll 21.

It can be preferred that receivers 60 be staged around that portion of the papermaking process where the papermaking belt 10 of the present disclosure is used. In particular it could be advantageous to position the receiver(s) at locations that follow a heating process. For example, it may be advantageous to position receivers 60 after pre-dryer 26. In this manner, the temperature of the papermaking belt 10 having measurement devices 50 disposed therein or thereupon in the form of thermocouples, can provide in situ feed-back of actual, real-time temperatures experienced by the papermaking belt 10. By way of non-limiting example only, if a papermaking belt 10, having thermocouples disposed therein, experiences a papermaking process temperature that is higher than required or allowed upon exiting pre-dryer 26, the temperature of the pre-dryer 26 can be accordingly adjusted in order to reduce energy costs, produce paper products within specification, and preserve papermaking belt 10 life by reducing or even preventing the occurrence of micro-fractures or oxidation of the resin forming the papermaking belt 10 that causes the papermaking belt 10 to become brittle. All of these beneficial end results can result in lower manufacturing costs for paper products.

Fourth Step

The fourth step in the papermaking process involves applying a fluid pressure differential of a suitable fluid to the embryonic web 18 with a vacuum source to deflect at least a portion of the papermaking fibers in the embryonic web 18 into the conduits 36 of the papermaking belt 10 and to remove water from the embryonic web 18 through the conduits 36 to form an intermediate web 25 of papermaking fibers. The deflection also serves to rearrange the fibers in the embryonic web 18 into the desired structure.

Either at the time the fibers are deflected into the conduits 36 or after such deflection occurs, water is removed from the embryonic web 18 through the conduits 36. Water removal occurs under the action of the fluid pressure differential. It is important, however, that there be essentially no water removal from the embryonic web 18 prior to the deflection of the fibers into the conduits 36. As an aid in achieving this condition, at least those portions of the conduits 36 surrounded by the paper side network 34*a*, are generally isolated from one another. This isolation, or compartmentalization, of conduits 36 is of importance to insure that the force causing the deflection, such as an applied vacuum, is applied relatively suddenly and in a sufficient amount to cause deflection of the fibers. This is to be contrasted with the situation in which the conduits 36 are not isolated. In this latter situation, vacuum will encroach from adjacent conduits 36 which will result in a gradual application of the vacuum and the removal of water without the accompanying deflection of the fibers.

Fifth Step

The fifth step is traveling the papermaking belt 10 and the embryonic web 18 over the vacuum source described in the fourth step. The belt 10 carries the embryonic web 18 on its paper-contacting side 11 over the vacuum source. At least a portion of the textured backside 12 of the belt 10 is generally in contact with the surface of the vacuum source as the belt 10 travels over the vacuum source. Following the application of the vacuum pressure and the traveling of the papermaking belt 10 and the embryonic web 18 over the vacuum source, the embryonic web 18 is in a state in which it has been subjected to a fluid pressure differential and deflected but not fully dewatered, thus it is now referred to as intermediate web 25.

It could be advantageous to position the receiver(s) 60 at locations that follow such a vacuum process. For example, it may be advantageous to position receivers 60 after the vacuum source described supra. In this manner, the temperature of the papermaking belt 10 having measurement devices 50 disposed therein or thereupon in the form of a strain gauge can provide in situ feed-back of actual, real-time bending moment, stress, strain, erosion, and or combinations thereof experienced by the papermaking belt 10. By way of non-limiting example only, if a papermaking belt 10, having a strain gauge disposed therein, experiences a papermaking stress and/or strain that is higher than required or allowed upon exiting the vacuum source, the vacuum pressure applied by the vacuum source can be accordingly adjusted in order to reduce energy costs, produce paper products within specification, and preserve papermaking belt 10 life by reducing or even preventing the occurrence of micro-fractures or oxidation of the resin forming the papermaking belt 10 that causes the papermaking belt 10 to become brittle. All of these beneficial end results can result in lower manufacturing costs for paper products.

Sixth Step

The sixth step in the papermaking process is an optional step which comprises drying the intermediate web 25 to form a pre-dried web of papermaking fibers. Any convenient means conventionally known in the papermaking art can be used to dry the intermediate web 25. For example, flow-through dryers, non-thermal, capillary dewatering devices, and Yankee dryers, alone and in combination, are satisfactory.

After leaving the vicinity of vacuum box 24, the intermediate web 25, which is associated with the papermaking belt 10, passes around the return roll 19*a* and travels in the direction indicated by directional arrow B. The intermediate web 25 then passes through optional pre-dryer 26. This pre-dryer 26 can be a conventional flow-through dryer (hot air dryer) well known to those skilled in the art.

Receivers 60 can be staged around that portion of the papermaking process immediately after optional pre-dryer 26. This can provide for in situ feed-back of actual, real-time temperatures experienced by the papermaking belt 10 during exposure to pre-dryer 26 by measurement devices 50 disposed therein or thereupon. If a papermaking belt 10 having, for example, thermocouples disposed therein, experiences a pre-dryer 26 process temperature that is higher than required or allowed, the temperature of the pre-dryer 26 can be accordingly adjusted in order to reduce or even prevent the occurrence of micro-fractures or oxidation of the resin forming the papermaking belt 10 that causes the papermaking belt 10 to become brittle.

Seventh Step

The seventh step in the papermaking process provides for impressing the paper side network 34*a* of the papermaking belt 10 of the present disclosure into the pre-dried web by interposing the pre-dried web 27 between the papermaking belt 10 and an impression surface to form an imprinted web of papermaking fibers.

As illustrated in FIG. 1 when the pre-dried web 27 then passes through the nip formed between the impression nip roll 20 and the Yankee drier drum 28. As the pre-dried web 27 passes through this nip, the network pattern formed by the paper side network 34*a* on the paper-contacting side 11 of the papermaking belt 10 is impressed into pre-dried web 27 to form imprinted web 29.

By way of non-limiting example, receivers 60 can preferably be staged around and/or proximate to those portions of the papermaking process where the papermaking belt 10 is subjected to a compressionary process. For example, a receiver could be staged at that portion of the papermaking process that follows contact of the papermaking belt 10 in the nip formed between impression nip roll 20 and the Yankee drier drum 28. By way of example only, if a papermaking belt 10, having pressure sensors disposed therein, experiences a higher or lower pressure than what is required, allowed, or the most efficacious to effect transfer of the paper web from one portion of the process to another, the appropriate nip pressure can be accordingly adjusted. Additionally, other critical parameters can be observed and understood in this nip. This can include the nip gap profile uniformity, nip loading profile uniformity, PLI loading uniformity, nip width/belt age profiles, and nip pressure uniformity.

Additionally, receivers 60 can also preferably be staged around those portions of the papermaking process where the papermaking belt 10 is subjected to other process forces. By way of non-limiting example, it can be seen in real-time if the papermaking belt 10 is experiencing any Poisson contraction effects resulting from thermal or mechanical induced over-stretching of the papermaking belt 10. Additionally, equipment misalignments can be detected by monitoring the pressures observed by the papermaking belt 10. Other critical parameters can be observed and understood. This can include the nip gap profile uniformity, nip loading profile uniformity, PLI loading uniformity, nip width/belt age profiles, and nip pressure uniformity. And measurement device 10 could be a chemical sensor to monitor water quality or running pH conditions in the papermaking process. Process anomalies can be detected by providing a measurement device 10 in the form of a plurality of strain gauges disposed within the papermaking belt 10 across the CD (e.g., the center and edges of papermaking belt 10) in order to understand, observe, and control the bending moment (i.e., bow deflection and/or skew) experienced by the papermaking belt 10 in process equipment (e.g., a Mt. Hope roll). Additionally, providing measurement device 10 as an accelerometer would be a unique method to understand, observe, and control speed changes between driven rolls of process equipment as well as adjust speeds for drive tuning.

These examples of the usefulness of the unique papermaking belt 10 can result in a reduction in energy costs, increase papermaking belt 10 life as well as increase the life of the contacted components by reducing wear on the contacting surfaces. It is reasonably believed, without being drawn to any particular theory, that papermaking belt 10 life can be at least doubled by reducing the detrimental effects experienced by the resin. All of these end results can result in lower manufacturing costs for paper products.

In any regard, the data measured by the measuring device 50 can be incorporated into a database that can be used to establish a papermaking belt 10 profile or a papermaking process profile. The collected data can be compared to an idealized or modeled set-point profile. Additionally, the data, and/or the profile can be looped back into the papermaking process. This can allow the adjustment of process temperatures, nip pressures, and the like in situ. Alternatively, the data and/or profile can be used to provide a historical perspective on papermaking belt 10 performance benchmarking over time as well as expected papermaking belt 10 life. Further, the data and/or profile can be used to manage process spikes such as web breakages, e-stops, and power outages that can cause manufacturing equipment to stop but not significantly reduce operating temperatures instantaneously.

Eighth Step

The eighth step in the papermaking process is drying the imprinted web 29. The imprinted web 29 separates from the papermaking belt 10 of the present disclosure after the paper side network 34*a* is impressed into the web to from imprinted web 29. As the imprinted web 29 separates from the papermaking belt 10 of the present disclosure, it is adhered to the surface of Yankee dryer drum 28 where it is dried.

Ninth Step

The ninth step in the papermaking process is the foreshortening of the dried web (imprinted web 29). This ninth step is an optional, but highly preferred, step. Foreshortening refers to the reduction in length of a dry paper web which occurs when energy is applied to the dry web in such a way that the length of the web is reduced and the fibers in the web are rearranged with an accompanying disruption of fiber-fiber bonds. Foreshortening can be accomplished in any of several well-known ways. The most common, and preferred, method is creping.

In the creping operation, the dried web 29 is adhered to a surface and then removed from that surface with a doctor blade 30. The surface to which the web is usually adhered also functions as a drying surface. Typically, this surface is the surface of a Yankee dryer drum 28. The paper web 31 is then ready for use.

All publications, patent applications, and issued patents mentioned herein are hereby incorporated in their entirety by reference. Citation of any reference is not an admission regarding any determination as to its availability as prior art to the claimed invention.

The dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a papermaking belt, said papermaking belt comprising a reinforcing structure and a framework, the method comprising the steps of:

(a) providing a woven reinforcing structure having a paper-facing side, a machine-facing side opposite said paper-facing side, interstices and a reinforcing component comprised of a plurality of structural components;

(b) attaching a discrete measuring device to a first position of said woven reinforcing structure, said discrete measuring device being disposed upon a reinforcing component; and, (c) coating said woven reinforcing structure with a material so that said material forms a first surface and a second surface relative to said paper-facing and machine-facing sides, said material being distributed so that said paper-facing side of said reinforcing structure and said measuring device are positioned between said first and second surfaces of said material.

2. The method of claim 1 further comprising the steps of:

(d) providing a forming unit having a working surface;

(e) prior to step (c), bringing at least a portion of said machine-facing side of said reinforcing structure into contact with said working surface of said forming unit; and, (f) distributing said material so that at least a portion of said second surface of said material is positioned adjacent said working surface of said forming unit.

3. The method of claim 2 further comprising the steps of:

(g) providing a mask having opaque and transparent regions, said opaque regions together with said transparent regions defining a preselected pattern in said mask; and, (h) positioning said mask between said material and a source of actinic radiation so that said mask is in contacting relation with said first surface of said material, said opaque regions of said mask shielding a portion of said material from said source of actinic radiation and said transparent regions leaving other portions of said material unshielded.

4. The method of claim 3 further comprising the step of:

(i) providing said material as a photosensitive resin, said mask forming said shielded and unshielded portions.

5. The method of claim 4 further comprising the steps of:

(j) curing said unshielded portions of photosensitive resin;

(k) leaving said shielded portions and those portions of said coating positioned between said first portion of said reinforcing structure and the working surface of said forming unit uncured by exposing said photosensitive resin to light having an activating wavelength from said source of actinic radiation through said mask and through said reinforcing structure to form a partially-formed composite belt.

6. The method of claim 5 further comprising the step of:

(l) removing substantially all uncured photosensitive resin from said partially-formed composite belt to leave a hardened resin framework which has a plurality of conduits in those regions which were shielded from said light rays by the opaque regions of the mask and passageways that provide surface texture irregularities in the backside network of said framework which correspond to those portions of the second surface of the coating which were prevented from curing by the first portion of the reinforcing structure.

7. The method of claim 4 further comprising the step of:

(j) providing said photosensitive resin as a liquid photosensitive resin.

8. The method of claim 2 further comprising the steps of:

(g) providing a portion of said material positioned between said first surface of said coating and said paper-facing side of said reinforcing structure with an overburden; and, (h) controlling the thickness of said overburden to a preselected value.

9. A method of making a papermaking belt, said papermaking belt comprising a reinforcing structure and a framework, the method comprising the steps of:

(a) providing a woven reinforcing structure having a paper-facing side, a machine-facing side opposite said paper-facing side, interstices and a reinforcing component comprised of a plurality of structural components;

(b) attaching a discrete measuring device at a first position upon a surface of said woven reinforcing structure, said discrete measuring device being disposed within a reinforcing component; and, (c) coating said woven reinforcing structure with a material so that said material forms a first surface and a second surface relative to said paper-facing and machine-facing sides, said material being distributed so that said paper-facing side of said reinforcing structure and said measuring device are positioned between said first and second surfaces of said material.

10. The method of claim 9 further comprising the steps of:

(d) providing a forming unit having a working surface;

(e) prior to step (c), bringing at least a portion of said machine-facing side of said reinforcing structure into contact with said working surface of said forming unit; and, (f) distributing said material so that at least a portion of said second surface of said material is positioned adjacent said working surface of said forming unit.

11. The method of claim 10 further comprising the steps of:

(g) providing a mask having opaque and transparent regions, said opaque regions together with said transparent regions defining a preselected pattern in said mask; and, (h) positioning said mask between said material and a source of actinic radiation so that said mask is in contacting relation with said first surface of said material, said opaque regions of said mask shielding a portion of said material from said source of actinic radiation and said transparent regions leaving other portions of said material unshielded.

12. The method of claim 11 further comprising the step of:

(i) providing said material as a photosensitive resin, said mask forming said shielded and unshielded portions.

13. The method of claim 12 further comprising the steps of:

(j) curing said unshielded portions of photosensitive resin;

(k) leaving said shielded portions and those portions of said coating positioned between said first portion of said reinforcing structure and the working surface of said forming unit uncured by exposing said photosensitive resin to light having an activating wavelength from said source of actinic radiation through said mask and through said reinforcing structure to form a partially-formed composite belt.

14. The method of claim 13 further comprising the step of:

(l) removing substantially all uncured photosensitive resin from said partially-formed composite belt to leave a hardened resin framework which has a plurality of conduits in those regions which were shielded from said light rays by the opaque regions of the mask and passageways that provide surface texture irregularities in the backside network of said framework which correspond to those portions of the second surface of the coating which were prevented from curing by the first portion of the reinforcing structure.

15. The method of claim 12 further comprising the step of:

(j) providing said photosensitive resin as a liquid photosensitive resin.

16. A method of making a papermaking belt, said papermaking belt comprising a reinforcing structure and a framework, the method comprising the steps of:

(a) providing a woven reinforcing structure having a paper-facing side, a machine-facing side opposite said paper-facing side, interstices and a reinforcing component comprised of a plurality of structural components;

(b) and, coating said paper-facing side and said machine-facing side of said woven reinforcing structure with a material having at least one discrete measuring device disposed therein so that said material forms a first surface and a second surface relative to said paper-facing and machine-facing sides, said material being distributed so that said paper-facing side of said reinforcing structure and said at least one measuring device is positioned between said first and second surfaces of said material and said at least one discrete measuring device is disposed between said woven reinforcing structure and said first surface and proximate to said woven reinforcing structure.

17. The method of claim 16 further comprising the steps of:

(d) providing a forming unit having a working surface;

(e) prior to step (c), bringing at least a portion of said machine-facing side of said reinforcing structure into contact with said working surface of said forming unit; and, (f) distributing said material so that at least a portion of said second surface of said material is positioned adjacent said working surface of said forming unit.

18. The method of claim 17 further comprising the steps of:

(g) providing a mask having opaque and transparent regions, said opaque regions together with said transparent regions defining a preselected pattern in said mask; and, (h) positioning said mask between said material and a source of actinic radiation so that said mask is in contacting relation with said first surface of said material, said opaque regions of said mask shielding a portion of said material from said source of actinic radiation and said transparent regions leaving other portions of said material unshielded.

19. The method of claim 18 further comprising the steps of:

(i) providing said material as a photosensitive resin, said mask forming said shielded and unshielded portions;

(j) curing said unshielded portions of photosensitive resin;

(k) leaving said shielded portions and those portions of said coating positioned between said first portion of said reinforcing structure and the working surface of said forming unit uncured by exposing said photosensitive resin to light having an activating wavelength from said source of actinic radiation through said mask and through said reinforcing structure to form a partially-formed composite belt.

20. The method of claim 19 further comprising the step of:

(l) providing said photosensitive resin as a liquid photosensitive resin.

* * * * *